United States Patent [19]

Kvasnes

[11] 4,137,603

[45] Feb. 6, 1979

[54] PIVOT ASSEMBLIES OF SWING WINDOWS

[75] Inventor: Harald Kvasnes, Vegsund, Norway

[73] Assignee: Kva-Spil Ltd., Spjelkavik, Norway

[21] Appl. No.: 856,512

[22] Filed: Dec. 1, 1977

[30] Foreign Application Priority Data

Dec. 7, 1976 [NO] Norway ..... 764163

[51] Int. Cl.[2] ..... E05D 5/12; E05D 15/28

[52] U.S. Cl. ..... 16/169; 16/139; 49/246; 403/155; 403/161; 403/163

[58] Field of Search ..... 16/169, 139, 191, 146; 49/246, 247, 248, 250; 403/155, 161, 163, 297, 325

[56] References Cited

U.S. PATENT DOCUMENTS

| | | | |
|---|---|---|---|
| 2,811,349 | 10/1957 | Bondurant et al. | 49/248 X |
| 3,101,135 | 8/1963 | Neal et al. | 49/250 X |
| 3,164,054 | 1/1965 | Biesecker | 403/163 X |
| 3,722,142 | 3/1973 | Anderberg et al. | 49/248 |
| 3,750,227 | 8/1973 | Hayhurst et al. | 403/325 X |
| 3,867,044 | 2/1975 | Downing | 403/155 |

FOREIGN PATENT DOCUMENTS

| | | | |
|---|---|---|---|
| 1509516 | 12/1967 | France | 49/246 |
| 1555350 | 12/1968 | France | 403/163 |
| 1113648 | 5/1968 | United Kingdom | 49/248 |

*Primary Examiner*—James Kee Chi

*Attorney, Agent, or Firm*—Kenyon & Kenyon, Reilly, Carr & Chapin

[57] ABSTRACT

Pivot assembly of a swing window in the form of a pivotable window sash bounded by a stationary window frame. The assembly includes a pivot bearing formed as a socket for permanent location within a bore defined by the sash. A pivot pin connected to the frame is formed with a stop which when the pin is received in the bearing is designed to be lockingly engaged by a locking device supportable in the pivot bearing. In this way only a pivoting motion of the pin relative to the pivot bearing is permitted. This support of the locking device in the bearing occurs in a plane within both an adjacent side face of the sash and an adjacent end face of the bearing. Moreover, the device is directly actuable into and out of the locking engagement by axial displacement thereof via an adjacent opening in the side face of the sash.

11 Claims, 3 Drawing Figures

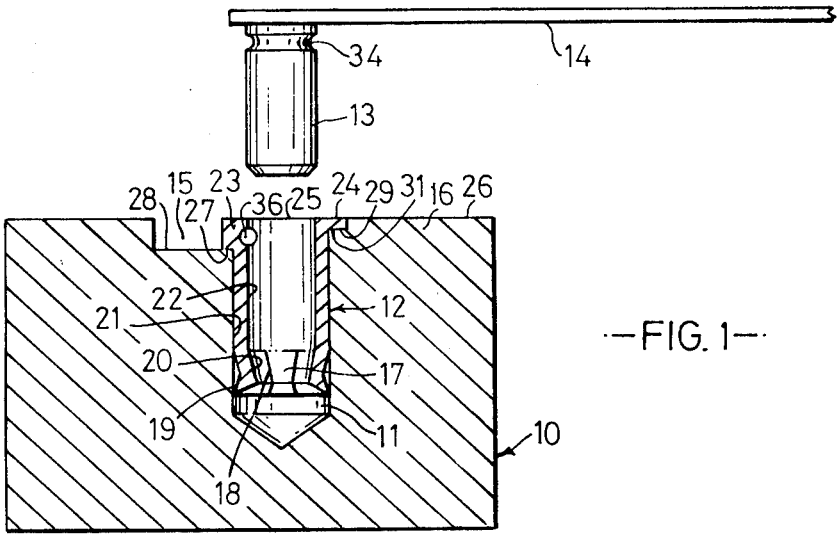
—FIG. 1—
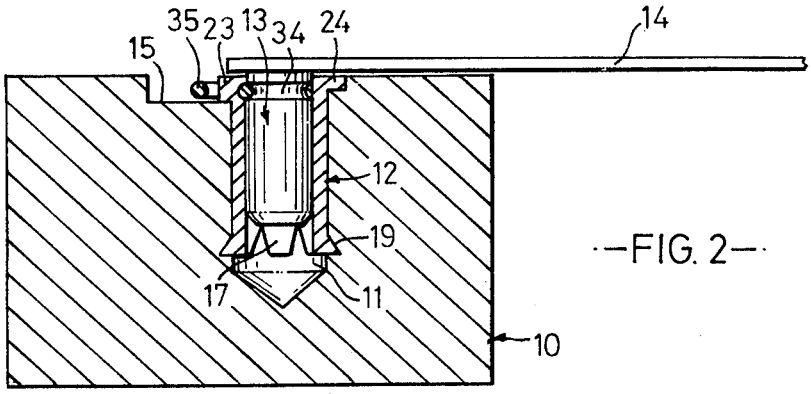
—FIG. 2—
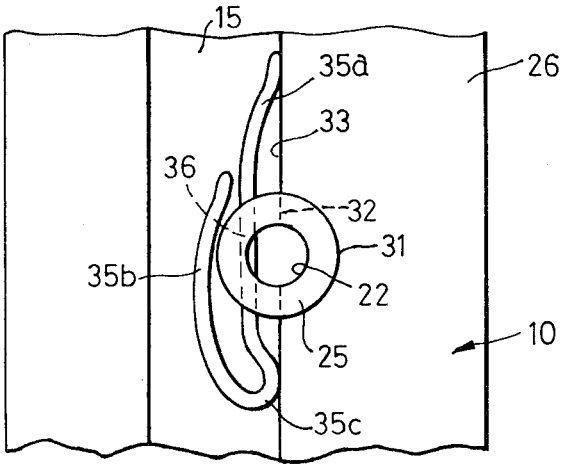
—FIG. 3—

PIVOT ASSEMBLIES OF SWING WINDOWS

This invention relates to pivot assemblies of swing windows and more particularly those of the turnable window type, that is to say a window in which the window sash can be rotated approximately 180° relative to the window frame.

Hitherto, it has been usual to prevent unintentional axial displacement of the pivot pin in the pivot bearing by fitting a screw or like locking device through the window sash from its outer side at right angles to the pivot pin. This device forms a locking engagement with an annular groove in the inner end of the pivot pin. The pivot pin is consequently locked by means of the locking device in direct engagement with the window sash itself but, if desired, the device can, in addition, also pass through a bore in the pivot bearing and is also locked thereby in combination with the pivot bearing. In all instances there is a demand for accuracy in the fitting of the locking device and a relatively extensive mounting operation in assembling pivot bearing and locking device. With the present invention, the aim is a simpler fitting of the locking device and an easier mounting of pivot bearing and locking means.

It has also been proposed to fit the pivot pin in a relatively easily detachable snap engagement with the pivot bearing by means of an elastically yielding locking device. In this way, there is obtained a ready mounting of the pivot pin in the pivot bearing and an easy dismantling of the pivot pin from the pivot bearing. However, the easily detachable snap engagement will not be fully acceptable in use since it does not provide sufficient safeguard for the window under all conditions of use, for example, in the outwardly swung position when it is exposed to wind gusts or the like. There is thus a demand that the pin be pivotably mounted in a secure fashion in the pivot bearing under all conditions of use.

It has also been usual to connect the pivot bearing to a mounting which is received in a cavity or milling out in the window sash while the pivot bearing is received in an adjacent bore in the window sash, and which is secured to the window sash with a number of fastening screws. Such mountings with pivot bearings are of relatively complicated design and are relatively complicated to fit in place in the window sash. However, pivot bearings of thimble form and cup form are also known which can be fitted in place in a bore in the window sash by means of suitable self-locking fastening means so that one is independent of conventional mountings. In the solution according to the invention, there can be employed such a simply designed pivot bearing.

According to the present invention a pivot assembly of a swing window comprises a pivotable window sash bounded by a stationary window frame. The pivot assembly comprises a pivot bearing in the form of a socket adapted for pushing axially into and locating permanently within a bore formed in the sash, a locking device supportable in the pivot bearing in a plane within both an adjacent end face of the bearing and an adjacent face of the sash, and a pivot pin connected to the frame for reception in the bearing. The pin is formed with a stop designed to be lockingly engaged by the locking device when the pin is received in the bearing. Thus, only a pivoting motion of the pin relative to the bearing is permitted. The locking device is directly actuable into and out of locking engagment by axial displacement thereof via an adjacent opening in the side face of the sash.

There is thus achieved a pivot assembly embodying a simple construction for the pivot bearing and, at the same time, a simple and easily accessible locking arrangement with several constructional and useful advantages. For example, one has the possibility of readily gaining access to the locking device for release of the locking engagement while, at the same time, the locking device is effectively shielded within the main plane of the window sash. By placing the locking device at the outer end of the pivot bearing, there is also the possibility of establishing the locking engagement between pivot pin and pivot bearing independently of the axial extension of the pivot bearing and/or the pivot pin. This last-mentioned point can be of significance in such special circumstances where it is desirable, for particular reasons, to have a shorter pivot pin than is otherwise usual or where, for example, it can be appropriate with respect to the window sash to have a longer or shorter pivot bearing than is otherwise usual.

It is preferred that the locking device is received in a bore in a head portion at the outer end of the pivot bearing and that the end face of the pivot bearing or the head portion is aligned with the side face of the window sash, while the opposite face of the head portion forms a support abutment against the bottom surface of the opening, the locking device being moveable by actuation in a plane between the side face and the bottom surface. By means of the head portion one can, as is known, decide the position of the pivot bearing and the support abutment relative to the window sash in a ready manner. At the same time, the head portion can be employed as an anchoring portion for the locking device so that the latter can be supported in a reliable manner in the pivot bearing and can establish the locking device in a predetermined and desired location relative to the side face of the window sash. A particular advantage is that a groove can be used as the opening for actuation of the locking device which is utilised for another purpose in the window sash. For example, there can be utilised a groove as described in U.S. patent application Ser. No. 851,671, filed Nov. 15, 1977. Instead or in addition, there can be made, if desired, a cavity, for example, a cutting in the face of the window just by the bore which receives the pivot bearing.

In forming the opening essentially only at the one side portion of the pivot bearing which includes the locking device one can, for example, additionally allow the locking device to form a slide abutment against one side edge of the opening so that the locking device is prevented from being unintentionally displaced.

By allowing the head portion of the pivot bearing to be of asymmetrical design relative to the pivot axis of the pivot bearing and, at any rate, to have its greatest thickness on the side supporting the locking device, the head portion can prevent the pivot bearing from being turned relative to the bore in the window sash.

In order that the invention can be more clearly understood, a preferred embodiment thereof will now be described, by way of example, with reference to the accompanying drawings in which:

FIG. 1 is a sectional view of part of a window sash with associated pivot bearing and pivot pin, illustrating the mounting of same in the window sash, FIG. 2 is the same as in FIG. 1 showing the bearing and pin in the finally mounted condition, and FIG. 3 is a side view of part of the window sash in the region of the pivot bearing.

Referring to FIGS. 1 and 2, a window sash 10 has a bore 11 in which there is received a pivot bearing 12 of thimble form for a pivot pin 13 which is secured to one end of a swivel arm 14.

The window sash is included in a window of the turnable window type, that is to say a window in which the window sash can be turned approximately 180° relative to the window frame. The turning occurs with the aid of a swivel arm mechanism in which the swivel arm 14 is included and by means of an additional slide connection between window sash and window frame. The pivot assembly of this embodiment is specially designed for a turnable window of the type which is shown in Norwegian Patent Specification No. 122,614. However, it can be incorporated in other arbitrary types of turnable windows and other types of swing windows. The window sash illustrated is provided with a longitudinal groove 15 (FIG. 3) which is hollowed out of the window sash stock during the production of the latter and extends the whole periphery of the window sash and can, for example, serve the same purpose as in the window arrangement described in U.S. patent application Ser. No. 851,671. It is evident from the drawing that the bore 11 is extracted partially from the groove 15 and partially from the groove-defining portion 16 of the window sash. The window sash is made of timber but can, alternatively, be made of another suitable arbitrary material, for example, laminated wood and a reinforced synthetic plastics material.

The pivot bearing 12 per se is made of metal, for example, bearing metal but can, if desired, be made of a suitable synthetic plastics material. The pivot bearing 12 is substantially thimble-shaped with a lower skirt portion 17 which is split endways with incisions 18. The skirt portion 17 is provided with outwardly directed, tapered flange portions 19. In FIG. 1, the pivot bearing is pushed axially inwards into the bore 12 and the skirt portion is shown in an inoperative condition, that is to say with converging inner skirt faces 20 and with the flange portions 19 flush with the outer thimble face 21 of the pivot bearing. In FIG. 2, the skirt portion is shown in a deformed condition with the inner skirt faces 20 extending flush with the inner thimble face 22 defining a bore of the pivot bearing and with the flange portions 19 projecting radially outside the outer thimble face 21 of the pivot bearing. The deformation of the skirt portion can be effected by means of a drift which is introduced into the pivot bearing after the latter is installed in the position illustrated in FIG. 1. By means of the effected deformation, the pivot bearing can be secured in a simple manner in an undisplaceable way in the associated bore of the window sash.

In order to obtain accurate localisation of the pivot bearing 12 in the window sash, the pivot bearing is designed with an asymmetrically arranged head portion 23 which at the outwardly directed end face of the pivot bearing, extends over into and is terminated by a flange portion 24 so that there is formed a uniformly closed end face 25 (FIG. 3) at the outwardly directed end of the pivot bearing. The end face 25 is arranged to be substantially flush with the outer side face 26 of the window sash, while the under side 27 of the head portion 23 forms a support abutment against the bottom surface 28 of the groove 15 and the under side 29 of the flange portion forms an abutment against the side face 26 — or as is shown in the drawing the under side 29 of the flange portion 24 forms an abutment against the bottom surface of a corresponding cavity 31 in the side face 26 so that the end face 25 is exactly flush with the side face 26. Radial faces 32 (FIG. 3) of the head portion 23 form support abutments against one side face 33 of the groove 15 and form thereby an effective prevention against unintentional turning of the pivot bearing in the bore 15.

In this embodiment, there is shown a pivot bearing with deformable fastening means, but it is apparent that there can also be used a pivot bearing having, for example, rill-shaped fastening means or fastening means in the form of screw threads which can cut into the walls of the bore. If the pivot bearing is made, for example, of a synthetic plastics material, the pivot bearing can be formed, for example, with a cup shape and a fastening screw or similar fastening means can be allowed to pass through the bottom portion of the cup shape with fastening in the end portion of the bore.

There is formed in the pivot pin 13 a stop 34, in the form of an annular groove, for a locking member or device 35 which is detachably fastened to the pivot bearing 12. The locking member 35 can be made with a certain, limited spring action, being designed with a bow-shaped or hair pin-like form. One leg 35*a* of the bow passes through a bore 36 right through head portion 23 of the pivot bearing and crosses parts of the bore of the pivot bearing. By means of the stop-forming annular groove 34 on the pivot pin 13 and the cooperating locking member 35, one can ensure, with an effective locking engagement, an accurate positioning of the pivot pin and the associated swivel arm 14 relative to the pivot bearing 12 and the side face 16 of the window sash. On setting up or releasing the locking engagement, the locking member 35 can be displaced axially relative to the bore 36 in the groove 15. Referring especially to FIG. 3, there is utilised a design of locking member 35 with which displacement of the locking member unintentionally out of engagement with the pivot bearing can be counteracted and, in addition, pivoting of the locking member unintentionally outside the groove 15 can be counteracted, that is to say outside the side face 26 of the window sash. In this connection, the locking member is provided with curved bow legs 35*a*, 35*b* and a transition portion 35*c* which, together with the outer end of the bow leg 35*a*, ensure the abutment between the locking member and the side face 33 of the groove 15, while the bow leg 35*b* or the transition portion 35*c* and the bow leg 35*a* prevent rocking about of the locking member by supportingly abutting the bottom 28 of the groove 15.

What we claim is:

1. In a swing window comprising a pivotable window sash bounded by a stationary window frame, a pivot assembly which comprises a pivot bearing in the form of a socket adapted for pushing axially into and locating permanently within a bore defined by said sash, a pivot pin connected to said frame and for reception in said bearing, said pivot pin being formed with a stop designed to be lockingly engaged by a locking device when said pin is received in said bearing whereby only a pivoting motion of said pin relative to said bearing is permitted and the improvement consisting in said locking device being supportable in said pivot bearing in a plane within both an adjacent end face of said bearing and an adjacent side face of said sash and being directly actuable into and out of said locking engagement by axial displacement thereof via an adjacent opening in said side face of said sash.

2. The assembly of claim 1, wherein the locking device is supportable at an end side portion of the pivot bearing and the opening is disposed essentially at said end side portion.

3. The assembly of claim 1, wherein a head portion is disposed at the outer end of the pivot bearing and is formed at one side with a bore for supporting said locking device, the end face of said head portion being flush with the side face of the window sash while a face of said head portion opposite said end face forms a supporting abutment against the bottom surface of the opening and the locking device being displaceable on actuation in a plane between said side face and said bottom surface.

4. The assembly of claim 3, wherein the head portion of the pivot bearing is designed asymmetrically relative to the pivotal axis of said bearing and has a maximum thickness on its locking device-supporting side.

5. The assembly of claim 1, wherein the pivot pin is located at one end of a swivel arm of a swivel arm connection joining the window sash to the window frame.

6. In combination with a window sash having a side face, a bore disposed perpendicularly of said side face and a groove in said side face disposed transversely and in overlying relation to said bore; a pivot assembly comprising a pivot bearing secured in said bore, said pivot bearing having a bore and an asymmetrically arranged head portion including a flange portion received in recessed relation in said side face and an enlarged underside received in said groove;

a pivot pin rotatably and slidably received in said bore of said pivot bearing, said pin having an annular groove therein within said bearing; and a locking member detachably fastened to said pivot bearing, said member having a first leg passing through said head portion of said pivot bearing, a part of said bore of said bearing and a part of said annular groove in said pin to lock said pin axially within said pivot bearing.

7. The combination as set forth in claim 6 wherein said locking member is of hair-pin like form and said one leg is bowed to contact said sash along a wall of said groove thereof and wherein a second leg of said member is disposed outside said head portion.

8. The combination as set forth in claim 6 wherein said pivot bearing is made of metal and of thimble-shape with a split deformable skirt portion at one end opposite said head portion said skirt portion having outwardly directed tapered flange portions secured in said sash.

9. A pivot assembly for a window sash comprising a pivot bearing having a bore and a head portion at one end of said bore;

a pivot pin rotatably and slidably received in said bore of said pivot bearing, said pin having an annular groove therein within said bore; and a locking member detachably fastened to said pivot bearing, said member having a leg passing through said head portion in transverse intersecting relation with part of said bore and a part of said groove to lock said pin axially within said pivot bearing.

10. A pivot assembly as set forth in claim 9 wherein said ocking member is of hair-pin like form.

11. A pivot assembly as set forth in claim 9 wherein said pivot bearing is made of metal and of thimble-shape with a split deformable skirt portion at one end opposite said head portion, said skirt portion having outwardly directed tapered flange portions.

* * * * *